US005724841A

United States Patent [19]

Botteon

[11] Patent Number: 5,724,841

[45] Date of Patent: Mar. 10, 1998

[54] KEY AND CYLINDER LOCK UNIT

[75] Inventor: Renato Botteon, Vittorio Veneto, Italy

[73] Assignee: Silca, S.p.A., Italy

[21] Appl. No.: 836,977

[22] PCT Filed: Dec. 11, 1995

[86] PCT No.: PCT/EP95/04870

§ 371 Date: May 29, 1997

§ 102(e) Date: May 29, 1997

[87] PCT Pub. No.: WO96/20325

PCT Pub. Date: Jul. 4, 1996

[30] Foreign Application Priority Data

Dec. 27, 1994 [IT] Italy ..... VE94A0052

[51] Int. Cl.[6] ..... E05B 19/08; E05B 27/04

[52] U.S. Cl. ..... 70/493; 70/395; 70/399; 70/409

[58] Field of Search ..... 70/394–397, 399, 70/401, 406, 407, 409, 419–421, 493, DIG. 47

[56] References Cited

U.S. PATENT DOCUMENTS

| | | | |
|---|---|---|---|
| 1,567,979 | 12/1925 | Northrop | 70/493 X |
| 1,735,868 | 11/1929 | Klingel | 70/493 X |
| 2,032,974 | 3/1936 | Bradshaw | 70/421 |
| 3,974,670 | 8/1976 | Wolter | 70/493 |
| 4,683,740 | 8/1987 | Errani | 70/493 X |
| 5,170,651 | 12/1992 | Errani | 70/493 |

FOREIGN PATENT DOCUMENTS

| | | |
|---|---|---|
| 0354838 | 2/1990 | European Pat. Off. . |
| 2647841 | 12/1990 | France . |
| 3424307 | 1/1985 | Germany . |

*Primary Examiner*—Lloyd A. Gall
*Attorney, Agent, or Firm*—Hoffman, Wasson & Gitler, PC

[57] ABSTRACT

A key and cylinder lock unit, in which a key contains a shank provided with a pattern and with at least one movable member positioned at the front end thereof, the lock having a plug housed within a cylinder and provided with a plurality of substantially radial pins formed in two parts movable along corresponding radial channels provided partly in the plug and partly in the cylinder and, by way of springs, maintained with one end in the longitudinal seat provided in the plug for the insertion of the shank of the key. The plug contains along the seat a longitudinal groove closed at the key introduction end and housing the tapered end of all the pins, which completely traverse said seat. The movable member of the shank is of such shape as to be able to be deviated towards the longitudinal groove as a result of a progressive introduction of the shank into the seat, and to engage the end of successively encountered pins in order to shift them axially until they are able to slide along that surface of the shank comprising the pattern.

5 Claims, 2 Drawing Sheets

KEY AND CYLINDER LOCK UNIT

FIELD OF THE INVENTION

This invention relates to a key and cylinder lock unit.

DESCRIPTION OF THE PRIOR ART

Locks are known comprising a plug housed in a cylinder and provided with a plurality of radial pins formed in two parts movable along corresponding radial channels provided partly in the plug and partly in the cylinder. For a particular axial position of the various pins the surface of separation between the two parts thereof coincides with the surface of discontinuity between the plug and cylinder to allow this to be freely rotated by a key which, when inserted into the plug, determines that particular axial position of said pins by virtue of its pattern.

The level of lock security is related to the difficulty of forming a blank key, the number of possible patterns, and the difficult of duplicating a key using a blank, ie of cutting an uncut key.

To increase this level of lock security it has already been proposed to provide the key with a member which is movable relative to the remainder of the shank between a position in which it is totally contained within the overall contour of the key and a position in which it projects from this overall contour. The function of this movable member is to cooperate with a projection at the end of the seat provided in the plug to receive the key, and in this manner to cause the movable member to assume its projecting position, in which it can activate a further two-part pin housed partly in the plug and partly in the cylinder.

However even with this expedient, unauthorized operation of the lock is possible by a wrongdoer who, provided with an appropriate implement, can insert it into the seat provided in the plug for the key, in order to operate the various pins one at a time and cause them to assume that position which enables the plug to be rotated.

EP-A-0 354 838 discloses a safety cylinder of the type comprising at least one rotor mounted rotatably in a stator and possessing parallel to its axis a conduit suitable for the insertion of a key. For interaction with a key, of which the end of the active part forms as a whole an oscillating end piece, the conduit of the rotor possesses, at a distance from its entrance, a widened portion capable of allowing a tilting of the oscillating end piece of the key, with at least one piston entering this widened portion and governed by the entire combination to be adhered to and deflection means capable of directing this oscillating end piece onto this piston.

SUMMARY OF THE INVENTION

The main object of the invention is to provide a key and cylinder lock unit in which it is impossible to gain access to the key seat in the plug using implements other than the key itself.

A further object of the invention is to provide a key which is difficult to reproduce.

These and further aims are attained according to the invention through a key and cylinder lock unit, in which the key comprises a shank provided with a pattern and with at least one movable member positioned at the front end thereof, the lock comprising a plug housed within a cylinder and provided with a plurality of substantially radial pins formed in two parts movable along corresponding radial channels provided partly in the plug and partly in the cylinder and, by means of springs, maintained with one end in the longitudinal seat provided in said plug for the insertion of the shank of said key, characterised in that:

the plug comprises along said seat a longitudinal groove closed at the key introduction end and housing the tapered end of all the pins, which completely traverse said seat;

the movable member of the shank is of such shape as to be able to be deviated towards said longitudinal groove as a result of the progressive introduction of the shank into said seat, and to engage the end of the successively encountered pins in order to shift them axially until they are able to slide along that surface of said shank comprising said pattern.

BRIEF DESCRIPTION OF THE DRAWINGS

A preferred embodiment of the present invention and a modification thereof are described in detail hereinafter with reference to the accompanying drawings, in which.

DESCRIPTION OF PREFERRED EMBODIMENTS

Figure 1:
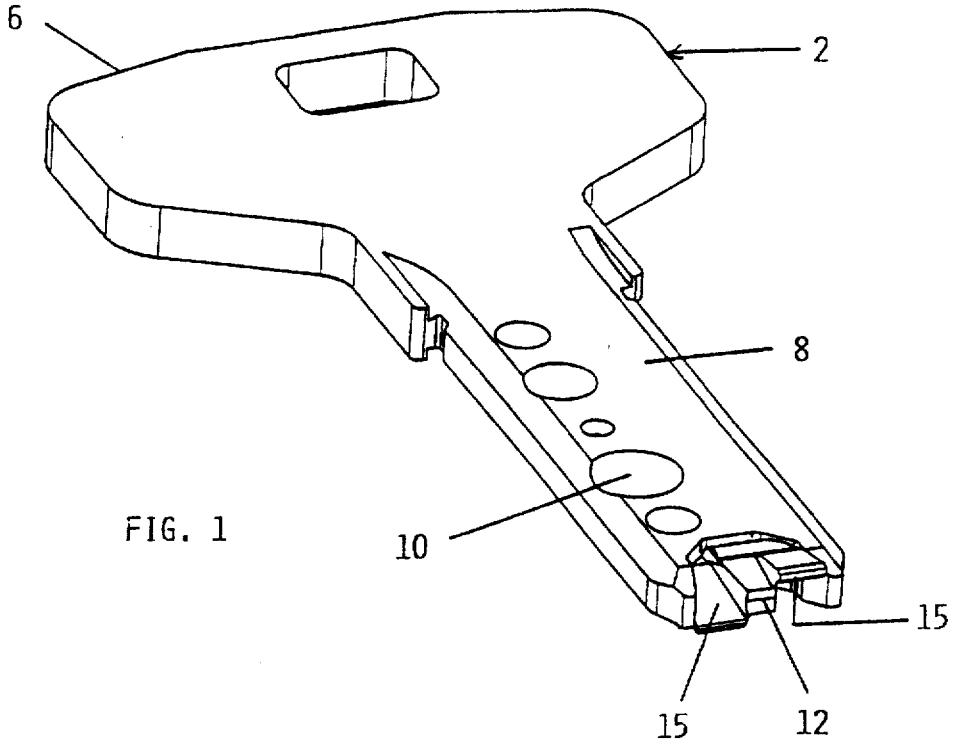
FIG. 1 is a perspective view of a key forming part of the unit according to the invention.
Figure 2:
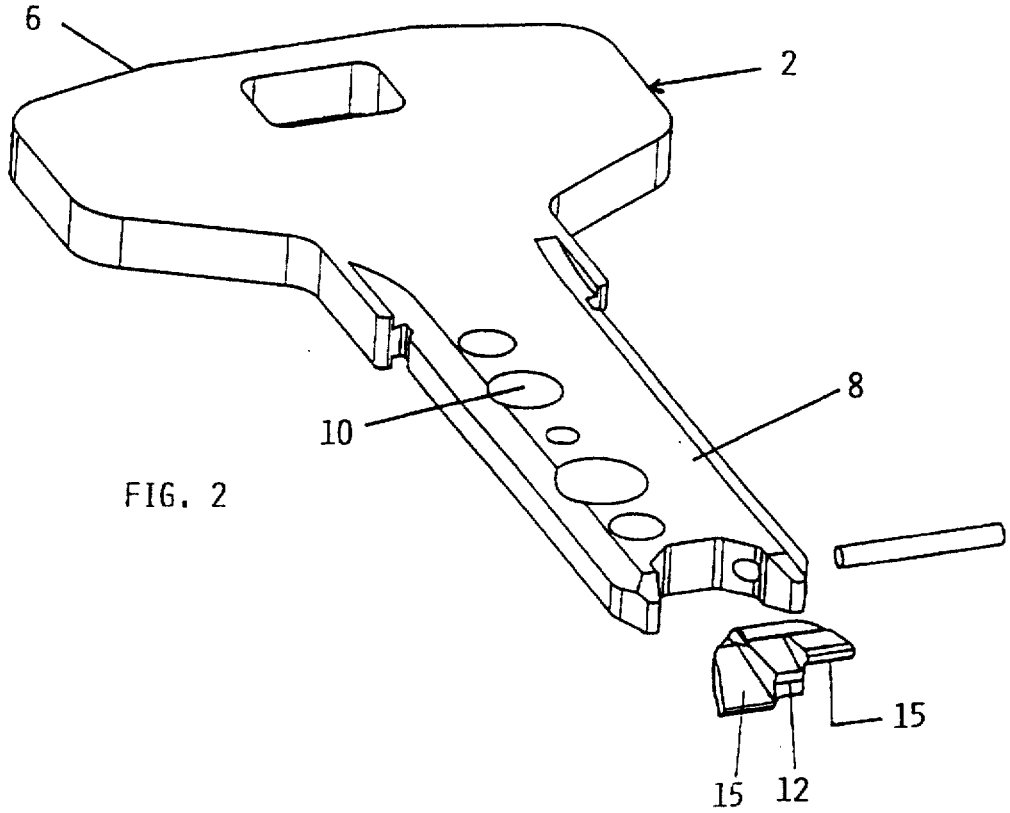
FIG. 2 shows it in the same view as FIG. 1, but in the exploded state.

As can be seen from the figures, the unit according to the invention comprises a key indicated overall by 2, and a lock indicated overall by 4. The key 2 comprises a head or handgrip 6 and an essentially flat shank 8 comprising in both surfaces a plurality of frusto-conical cavities 10 aligned along an axis parallel to the axis of the shank and forming the key pattern by virtue of their different depths. As the key is of the reversible type, the same sequence of frusto-conical cavities 10 is provided in both surfaces of the shank 8, in a position symmetrical about its longitudinal axis.

To the front end of the shank 8 there is pivoted a member 12 movable between two positions projecting from the overall contour of the shank and symmetrical about a central position totally contained within its overall contour.

The movable member 12 comprises two inclined surfaces 15 which are aligned with the corresponding rows of cavities 10 and, because of the key reversibility, are symmetrical about the longitudinal axis of the shank.

The lock 4 comprises a plug 14, which is provided with a traditional pawl (not shown) for operating a bolt and is housed within a cylinder 16, which in the illustrated example is a cylinder of European type.

In the cylinder 16 there are provided five cylindrical seats 18 having their axis perpendicular to the axis of the plug 14 and housing five pins 20 formed in two parts 20' and 20". That end of the part 20' of each pin 20 closer to the axis of the plug 14 is of frusto-conical shape complementary to the cavities 10 in the key 2, whereas the opposite end, ie the end of the part 20", is flat and forms a support for a coil spring 22 housed in the corresponding seat 18, between the pin 20 and the closure cap 24 for the seat.

The plug 14 is also provided with five cylindrical seats of diameter equal to that of the seats 18 and arranged such that for a particular angular position of the plug 14 relative to the cylinder 16 they are aligned with the seats 18.

The plug 14 also comprises an axial seat 28 complementary to the shank 8 of the key 2, which can hence be inserted into it. The cylindrical recesses of the plug open into a wall of the seat 28 corresponding to a major face of the shank 8, the opposite wall of said seat 28 being provided with a recess 30 closed at the end at which the key 2 is inserted. The dimensions of the recess 30 are such that it can completely house the frusto-conical end of the five pins 20, the cylindrical portions of which hence completely traverse the insertion seat 28 for the key 2.

The operation of the unit according to the invention is as follows:

with the key 2 withdrawn from the plug 14, the springs 22 urge the pins 20 such that they maintain their frusto-conical end housed in the recess 30. In this state, the surface of discontinuity between the two portions 20' and 20" of each pin 20 does not coincide with the surface of discontinuity between the plug 14 and the cylinder 16, and in particular the portions 20" of all the pins act to prevent rotation of the plug 14, so preventing operation of the lock bolt.

Figure 3:
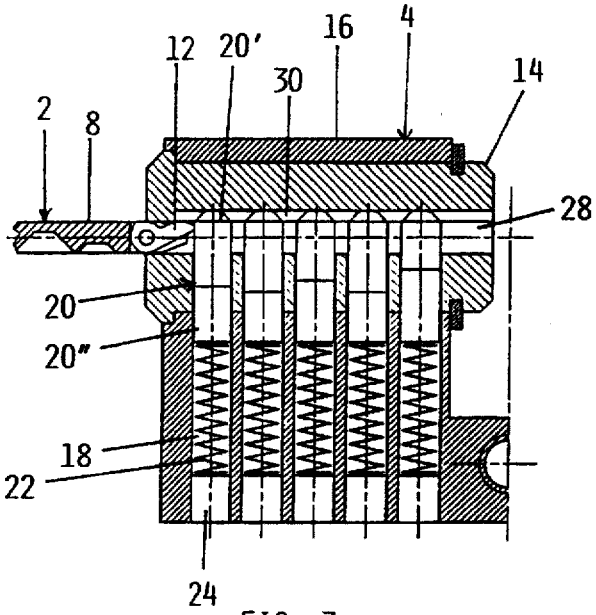
FIG. 3 is a longitudinal section through a lock of the unit according to the invention during the commencement of insertion of the key.
Figure 4:
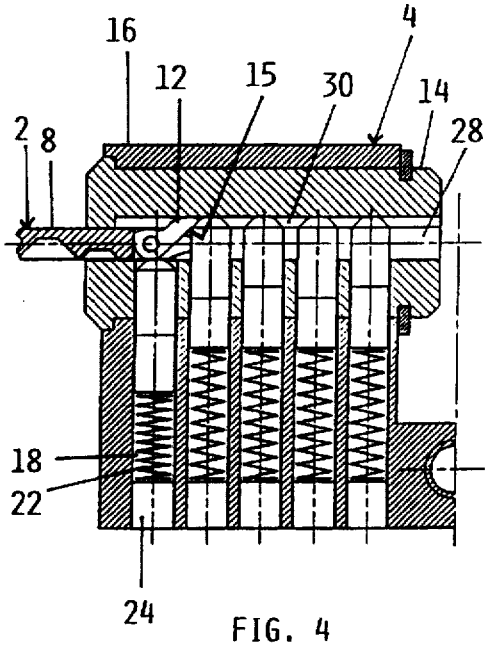
FIG. 4 shows it with the key further inserted.

During the insertion of the key into the seat 28 of the plug 14, when the end of the shank 8 or rather the movable member 12 pivoted to it encounters the cylindrical portion of the first pin 20 (see FIG. 3), it is deviated towards the recess 30, so that the end part of its inclined surface 15 enters it to engage the frusto-conical end of the pin. At this point, further insertion of the key 2 causes the frusto-conical end of the first pin 20 to slide along the inclined surface 15 of the advancing movable member 12, with consequent axial sliding of the pin along the respective cylindrical recess 18. This sliding of the pin 20 releases the seat 28 and enables the key 2 to be further inserted until the movable member 12 encounters the next pin 20 to repeat the same operational sequence.

When the key has been fully inserted, each pin 20 lies with its frusto-conical end housed in a corresponding frusto-conical recess 10 provided in the key shank 8, the depth of these recesses being related to the height of the two parts 20' and 20" of each pin 20, in the sense that when in that state the surface of discontinuity between the two parts 20' and 20" of each pin 20 coincides with the surface of discontinuity between the plug and cylinder 16, to enable the plug to be rotated by the key 2 to operate the bar.

The unit according to the invention is particularly advantageous in that for operating the lock, and in particular for axially moving the pins 20, it requires the use of a key which, because of the necessary presence of the movable member 12, is difficult to form and consequently offers a high degree of security. In particular, the unit according to the invention makes it impossible to insert a key which does not possess said movable member.

Moreover as the pins 20 completely obstruct the seat 28 by means of their cylindrical portion, it is practically impossible to reach the pin ends from the outside, these ends being housed in the recess 30. It is therefore practically impossible for a wrongdoer provided with a breaking implement to operate the lock.

Figure 5:
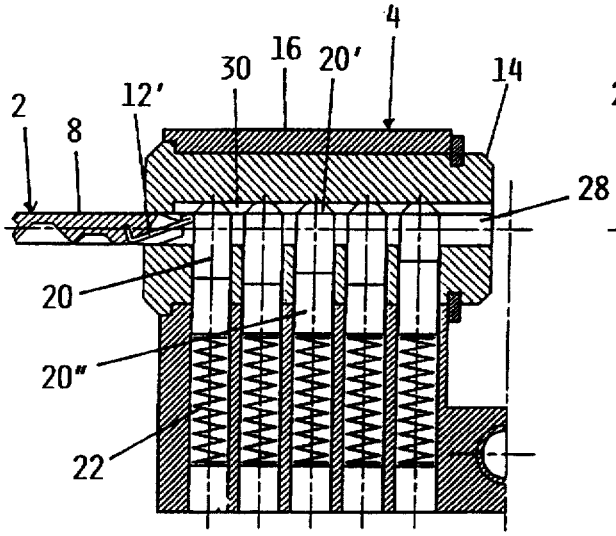
FIG. 5 shows it in the same view as FIG. 3 but with the movable member of the key formed differently.
Figure 6:
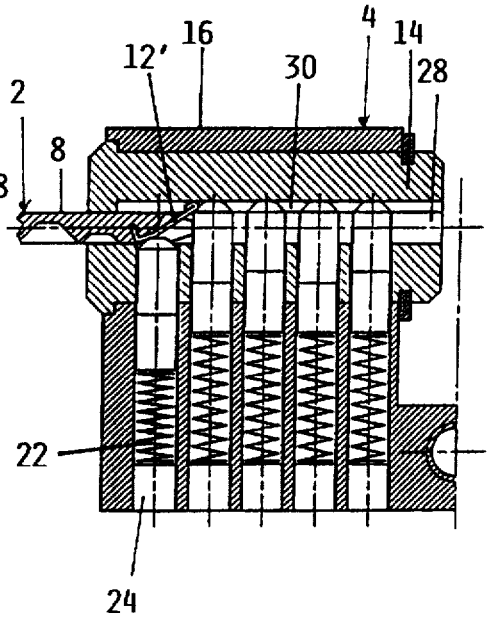
FIG. 6 shows this modified embodiment in the same state as FIG. 4.

In a modified embodiment (see FIGS. 5 and 6), the member provided at the end of the shank 8 of the key 2 is in the form of a flexible blade 12', which can likewise be deviated by the pins 20 towards the tapered end thereof and into the recess 30, to then axially move said pins.

I claim:

1. A key and cylinder lock unit, in which said key comprises a shank provided with a pattern and with at least one movable member positioned at a front end thereof, said lock comprising a plug housed within a cylinder and provided with a plurality of substantially radial pins formed in two parts movable along corresponding radial channels provided partly in said plug and partly in said cylinder and, by means of springs, maintained with one end in a longitudinal seat provided in said plug for the insertion of said shank of said key, wherein:

said plug comprises along said seat a longitudinal groove closed at the key introduction end and housing a tapered end of all the pins, which completely traverse said seat;

said movable member of said shank is of such a shape as to be able to be deviated towards said longitudinal groove as a result of a progressive introduction of said shank into said seat, and to engage the end of successively encountered pins in order to shift them axially until they are able to slide along a surface of said shank comprising said pattern.

2. A unit as claimed in claim 1, wherein said movable member is pivoted to the end of said shank and has an inclined surface which interacts with said tapered end of said pins.

3. A unit as claimed in claim 1, wherein said movable member consists of an elastic blade fixed to said end of said shank in a position inclined to a longitudinal axis thereof.

4. A unit as claimed in claim 1, wherein said longitudinal groove has a cross-section complementary to a shape of said tapered end of said pins.

5. A unit as claimed in claim 1, further comprising a key of reversible type, wherein said movable member is symmetrical about a longitudinal axis of said shank.

* * * * *